US007263990B1

(12) United States Patent
Lenhart

(10) Patent No.: US 7,263,990 B1
(45) Date of Patent: Sep. 4, 2007

(54) CONFIGURABLE OUTDOOR COOKING APPARATUS WITH COOKING TEMPERATURE CONTROL

(76) Inventor: Philip R. Lenhart, 1526 Marilyn Dr., Sidney, OH (US) 45365

( * ) Notice: Subject to any disclaimer, the term of this patent is extended or adjusted under 35 U.S.C. 154(b) by 282 days.

(21) Appl. No.: 11/059,062

(22) Filed: Feb. 16, 2005

Related U.S. Application Data

(60) Provisional application No. 60/545,202, filed on Feb. 17, 2004.

(51) Int. Cl.
*F24C 1/16* (2006.01)

(52) U.S. Cl. ..... 126/276; 126/268

(58) Field of Classification Search ..... 126/276, 126/268; 99/339, 340, 357
See application file for complete search history.

(56) References Cited

U.S. PATENT DOCUMENTS 4,321,857 A * 3/1982 Best ..... 99/340
5,628,242 A 5/1997 Higley
5,934,183 A 8/1999 Schlosser et al.
5,988,158 A 11/1999 Schmidt et al.
D472,756 S 4/2003 Pai
6,658,991 B2 12/2003 Backus et al.
2003/0140798 A1 7/2003 Rummel et al.
2003/0150336 A1 8/2003 Roescher

* cited by examiner

*Primary Examiner*—Alfred Basichas
(74) *Attorney, Agent, or Firm*—Mark A. Navarre

(57) ABSTRACT

A mobile cooking apparatus is configurable and automatically controlled to regulate the cooking temperature. The cooking apparatus is configurable as to fuel source (liquid propane or charcoal), and the temperature control is adaptable to the selected fuel. Additionally, smoke flavor may be optionally used, and various adjuncts such as a rotisserie, grill and deep fryer may be included.

14 Claims, 7 Drawing Sheets

CONFIGURABLE OUTDOOR COOKING APPARATUS WITH COOKING TEMPERATURE CONTROL

RELATED APPLICATIONS

This Non-Provisional Patent Application claims priority based on the Provisional Patent Application Ser. No. 60/545,202, filed Feb. 17, 2004.

TECHNICAL FIELD

The present invention relates to an outdoor cooking apparatus for on-site food preparation, and more particularly to a configurable cooking apparatus with automatic control of cooking temperature.

BACKGROUND OF THE INVENTION

Various outdoor cooking arrangements have been used for on-site food preparation at events such as private parties and picnics and public fairs and exhibitions. The food prepared for such events can include grilled items such as hamburgers and steaks, barbecued items such as whole chickens, and roasted items such as whole hogs. The heat is often provided by burning charcoal or liquid propane, and sometimes wood chips are also burned to give the food a smoke flavor. The most convenient cooking arrangement is in the form of a mobile unit that is towed to the food preparation site by a motor vehicle; see for example, the U.S. Pat. No. 5,988,158 to Schmidt, Jr. However, there remain health safety concerns about on-site outdoor food preparation because outdoor cooking devices typically include only manual temperature controls, and the operator may lack proper training in outdoor food preparation. Additionally, the cooking apparatus should be easy to use and configurable to satisfy different cooking requirements.

SUMMARY OF THE INVENTION

The present invention is directed to an improved cooking apparatus that is mobile, configurable and automatically controlled to regulate the cooking temperature. The cooking apparatus is configurable as to fuel source (liquid propane or charcoal), and the temperature control is adaptable to the selected fuel. Additionally, smoke flavor may be optionally used, and various adjuncts such as a rotisserie, grill and deep fryer may be included.

DESCRIPTION OF THE PREFERRED EMBODIMENT

Figure 1:
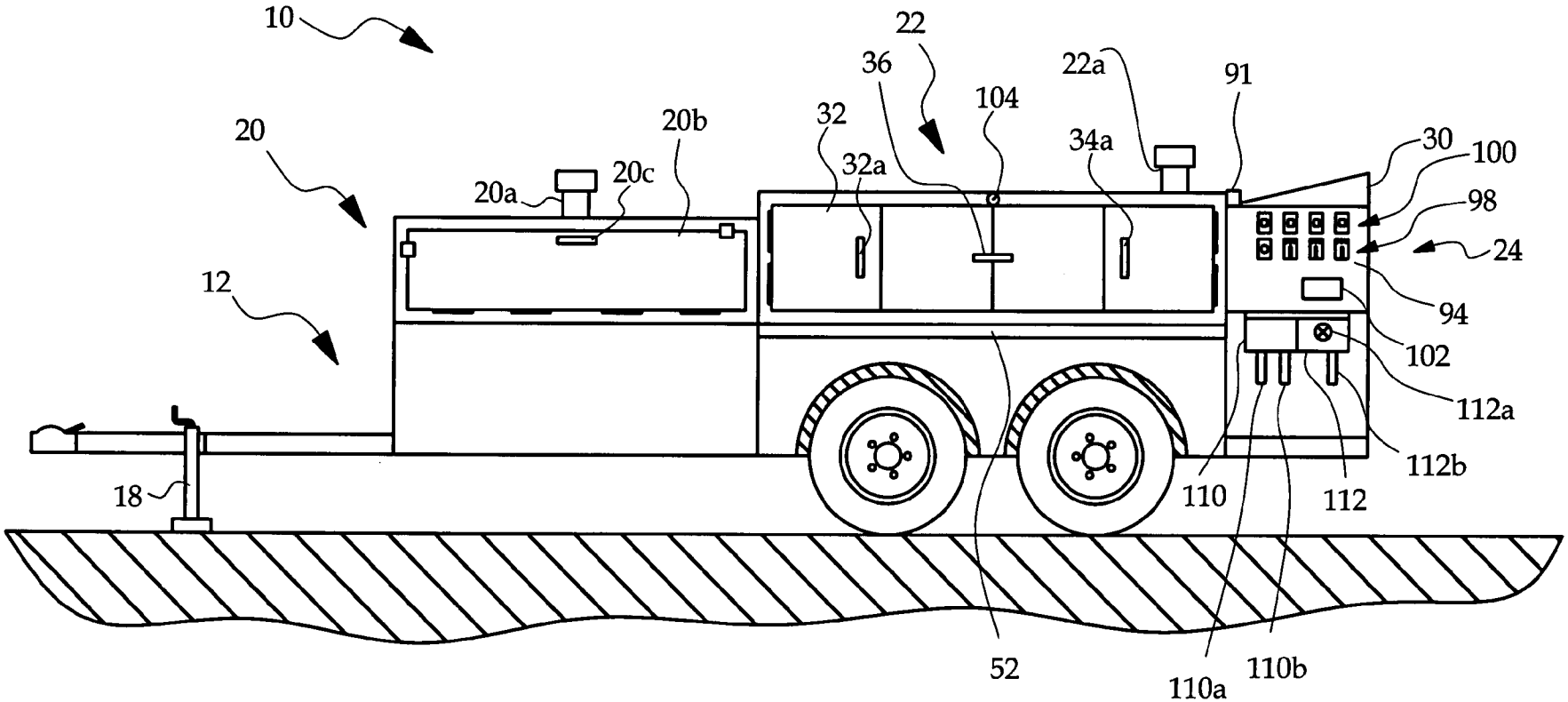
FIG. 1 is a side view of the mobile cooking apparatus of this invention, depicting a grill unit, a roaster unit and an electric control unit.

Referring to the drawings, and particularly to FIGS. 1-4, the reference numeral 10 generally designates a mobile cooking apparatus according to the present invention. The cooking apparatus 10 is mounted on a wheeled trailer frame 12 so that it can be towed to any convenient location and parked as a stand-alone food preparation center. Stabilizer jacks 14, 16 are provided at each rear corner of the trailer frame 12 in addition to the usual tongue jack 18. In the illustrated embodiment, the cooking apparatus 10 includes an LP grill unit 20, a roaster unit 22, an electrical control module 24, a smoker unit 26 and a deep-fryer unit 28. The deep-fryer unit 28 is designed for cooking large items such as a whole turkey, and includes a suitable pot 28*a*. The roaster unit 22 is ventilated by a shielded stack 22*a*, and the grill unit 20 is ventilated by a shielded stack 20*a*. The grill unit 20 and deep-fryer unit 28 can be operated independently, and are not functionally coupled to the roaster unit 22 apart from their common mounting on the trailer frame 12. For this reason, the grill unit 20, the smoker unit 26 and the deep-fryer unit 28 may be considered as optional equipment.

Figure 4:
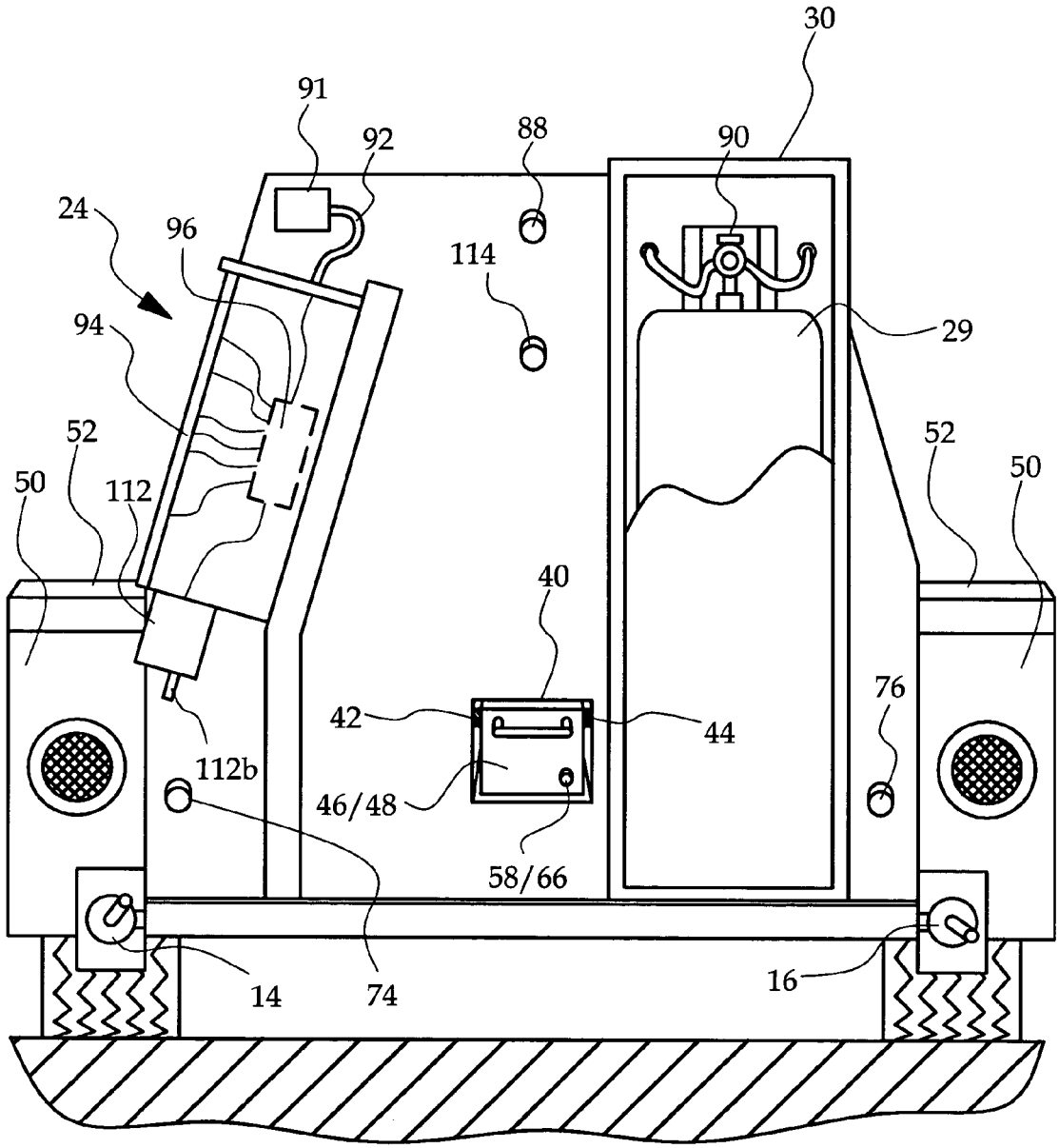
FIG. 4 is a rear view of the cooking apparatus of FIG. 1, depicting the roasting unit, a slide-in burner, and a primary LP tank.

A primary LP gas tank 29 supplies LP gas to the roaster unit 22, and is located in a closed compartment 30 at the rear of the trailer frame 12 as shown in FIG. 4. The grill unit 20 and roaster unit deep-fryer unit 28 are supplied by a separate LP tank housed in a storage compartment 32 at the front of the trailer 12.

Figure 2:
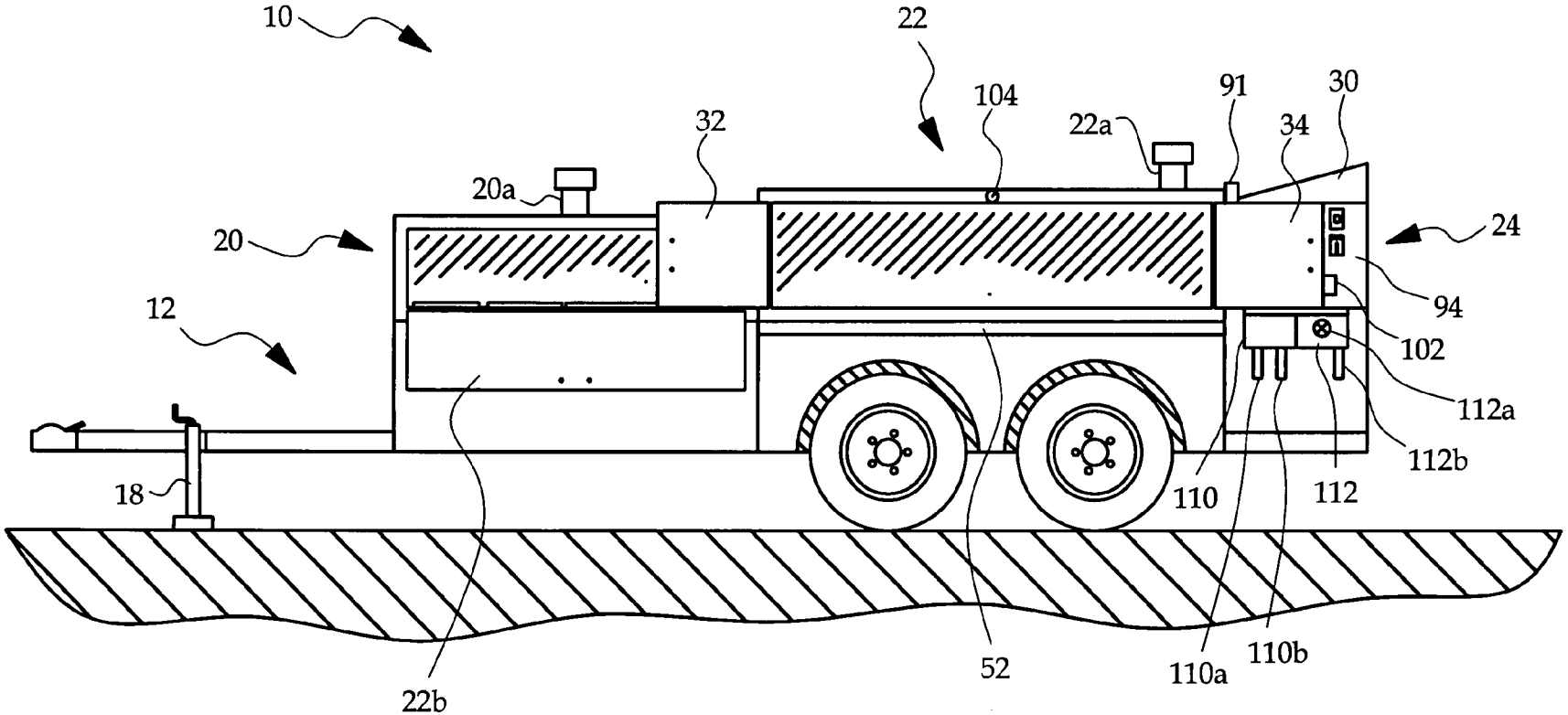
FIG. 2 depicts the cooking apparatus of FIG. 1, with the grill unit and roaster unit access doors opened.

The roaster unit 22 is the heart of the cooking apparatus 10, and includes left and right bi-fold access doors 32, 34 as seen in FIGS. 1-2. A latch 36 locks the access doors 32, 34 in a closed position during transmit, and insulated handles 32*a*, 34*a* are mounted on each access door 32, 34 for ease of opening and closing.

Figure 3:
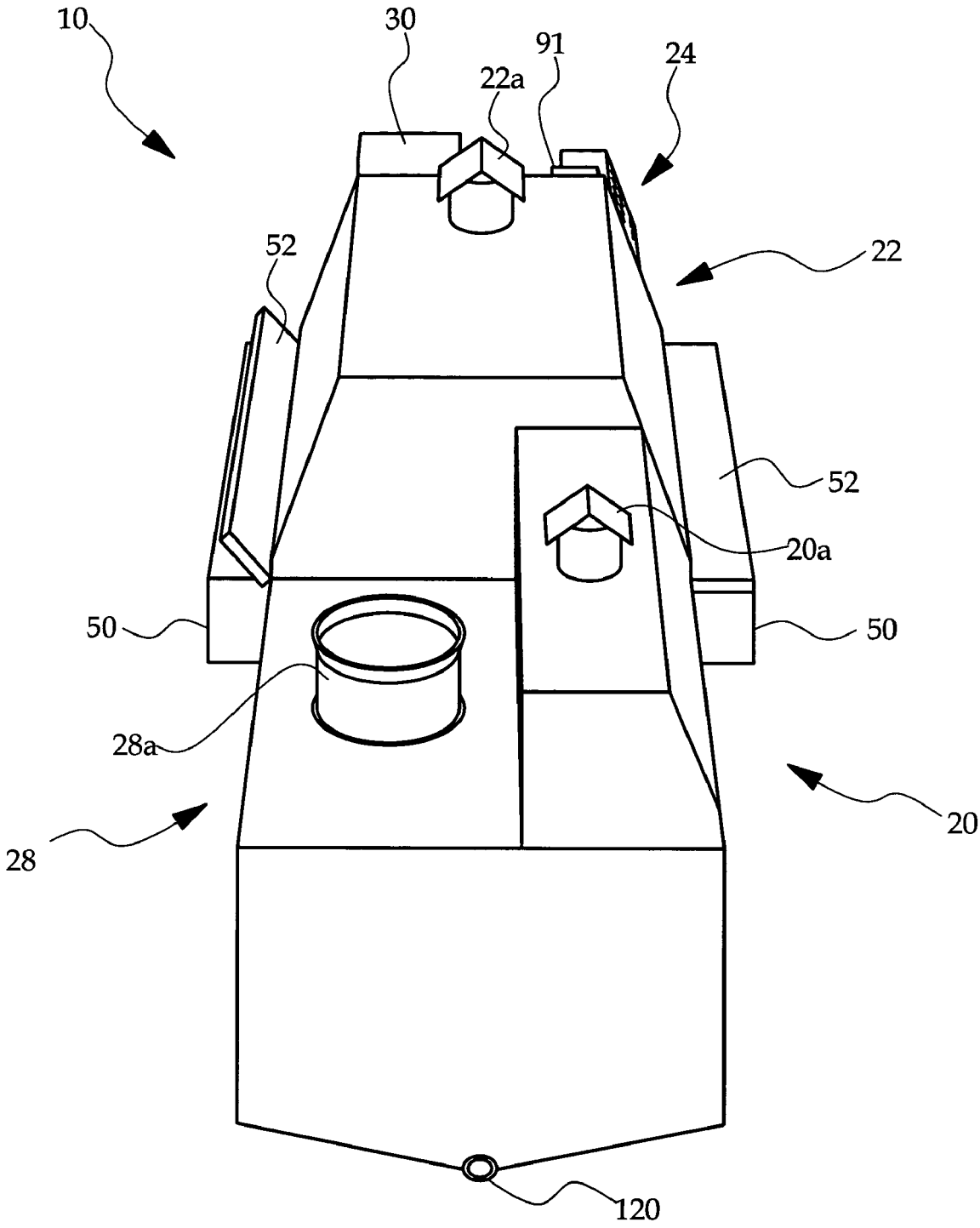
FIG. 3 is an isometric view of the top and front of the cooking apparatus of FIG. 1.
Figure 5:
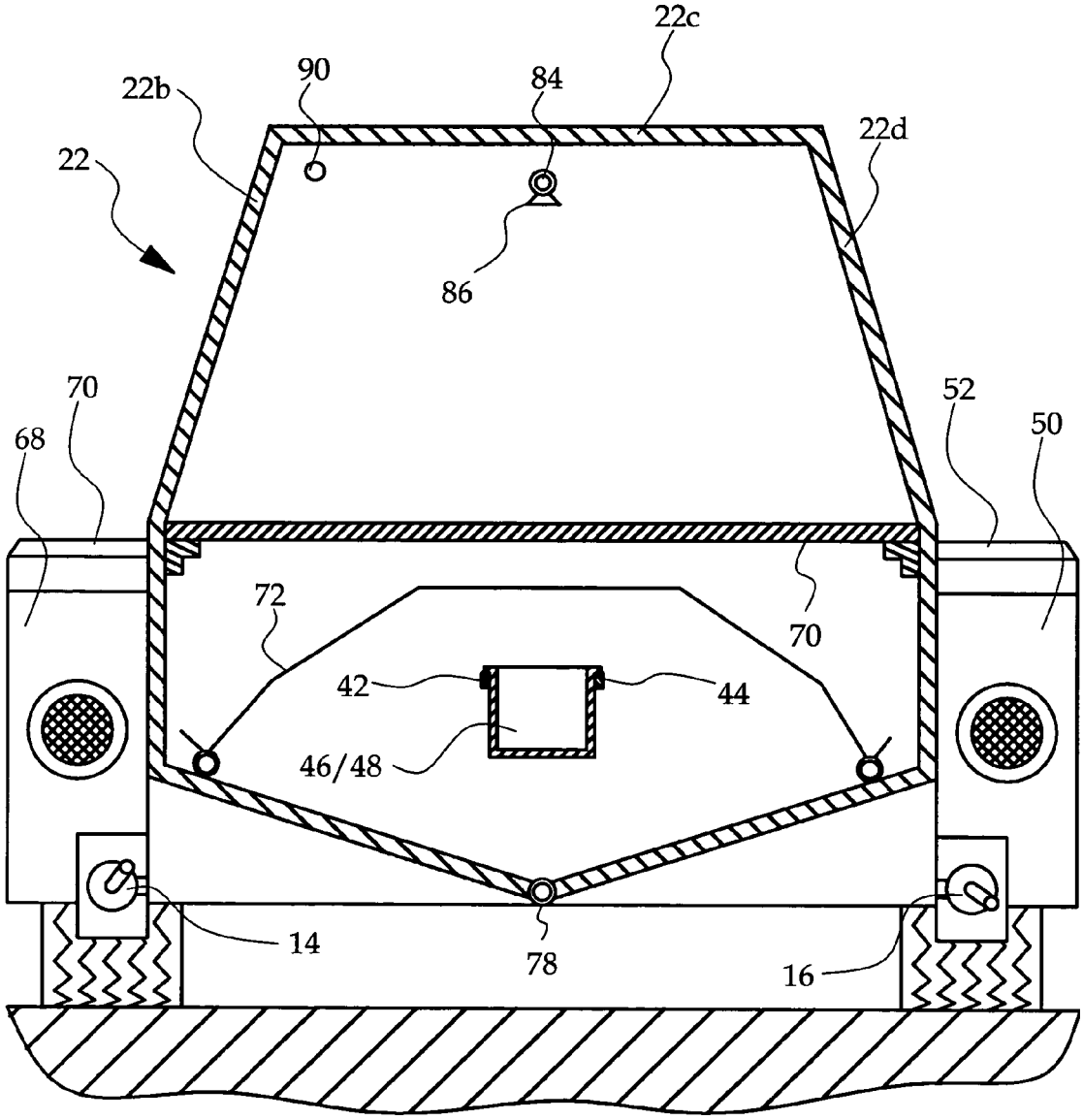
FIG. 5 is a cross-sectional view of the roaster unit of FIG. 4.

According to the invention, the roaster unit 22 can be configured to operate on either LP gas or charcoal at the operator's discretion. Referring to FIGS. 4-5, the roaster unit 22 has a rear access opening 40 and a set of internal support rails 42, 44 for receiving and supporting a slide-in heating unit 46 or 48. The operator simply decided upon the desired heat source (i.e., LP gas or charcoal) for the roaster unit 22, and then installs the appropriate heating unit 46 or 48. The heating unit 46 or 48 not in use may be conveniently stowed in one of two fender storage compartments 50 accessed by hinged covers 52, as illustrated in FIG. 3.

Figure 6A:
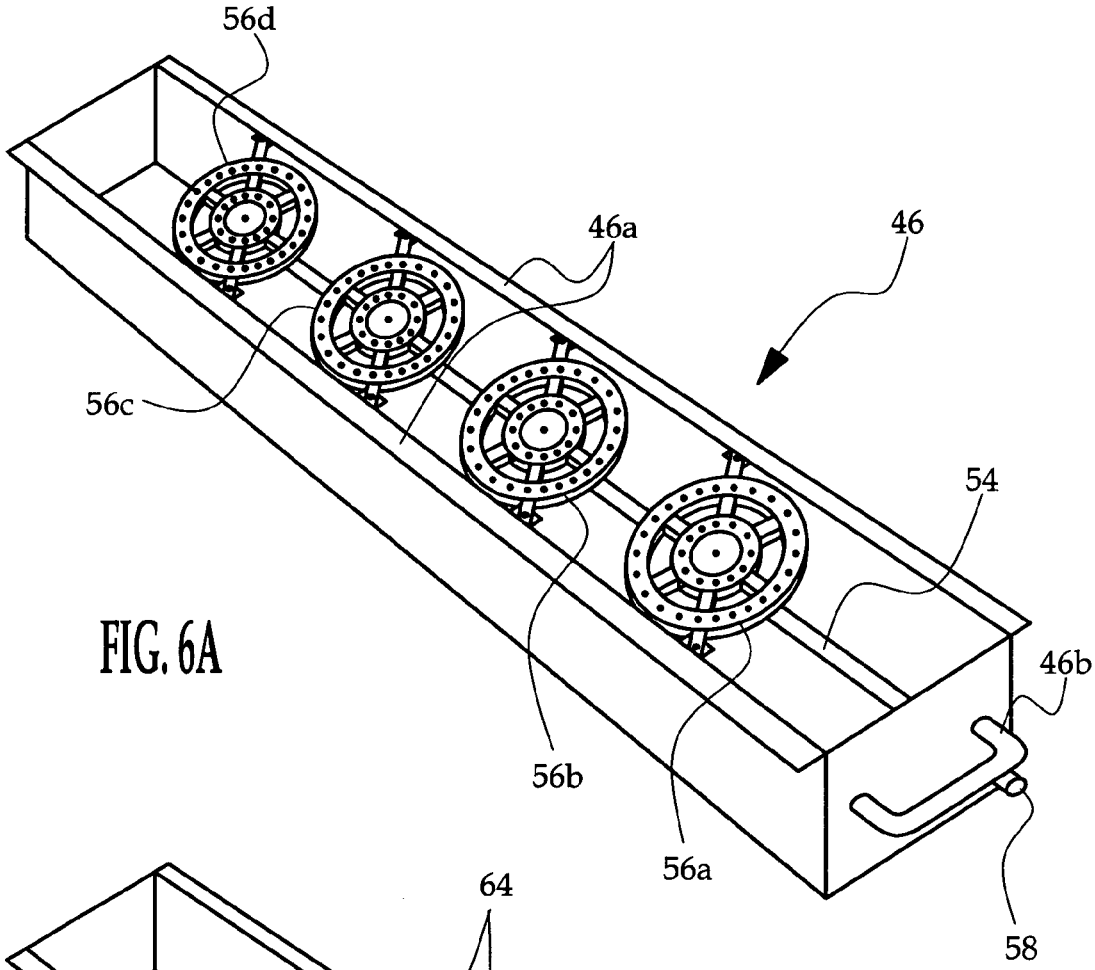
FIG. 6A depicts a slide-in LP burner for the roaster unit.
Figure 6B:
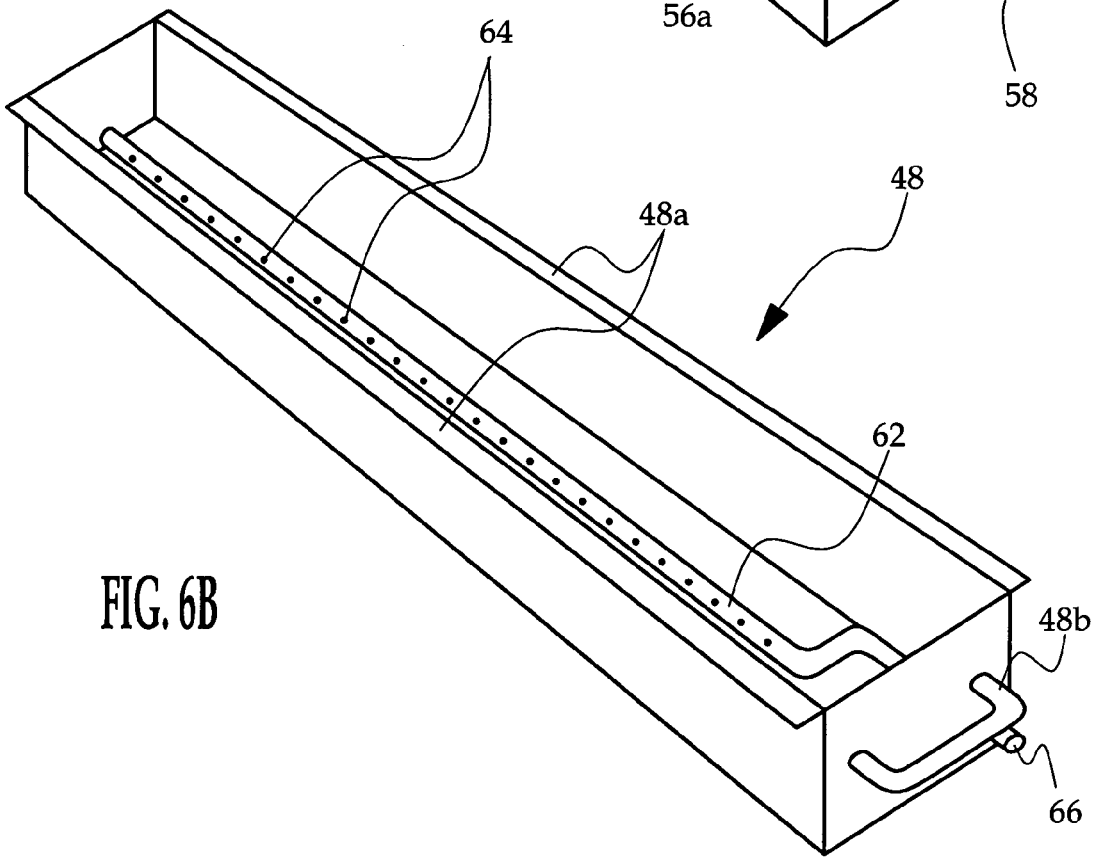
FIG. 6B depicts a slide-in charcoal burner for the roaster unit.

FIGS. 6A-6B respectively depict a slide-in LP heating unit 46 and a slide-in charcoal heating unit 48. The heating unit 46, 48 have essentially identical exterior dimensions, each including a set of flanges 46*a*/48*a* designed to ride on the internal support rails 42, 44 of roaster unit 22, and a handle 46*b*/48*b* designed to be grasped by the operator to facilitate their insertion and removal.

Referring to FIG. 6A, the LP heating unit 46 includes an LP gas pipe 54 for supplying LP gas to each of several gas burners 56*a*, 56*b*, 56*c*, 56*d* distributed throughout the length of the unit, each being adjustable for gas flow restriction. Once the LP heating unit 46 is installed, the operator simply couples the stub 58 of gas pipe 54 to the primary LP tank 29 with a flexible gas hose (not shown), and regulates the gas flow to the burners 56*a*-56*d* via the tank valve 60.

Referring to FIG. 6B, the charcoal heating unit 48 includes an air pipe 62 for supplying auxiliary combustion air along the length of the unit via the periodic openings 64. When the operator elects to use charcoal heating unit 48, the stub 66 of air pipe 62 is coupled to a temperature controlled blower unit 110, described below. Combustion air for the charcoal is supplied via the rear access opening 40.

Referring to FIG. 5, the walls 22*b*, 22*c*, 22*d* of roaster unit 22 are insulated, and enclose an adjustable height grating 70 above the heating unit 46 or 48. A grease shield 72 is interposed between the heating unit 46/48 and the grating 70, and includes integral troughs 72*a*, 72*b* for collecting all liquids that drip from meat being cooked in the roaster unit 22. The grease shield 72 is supported by interior brackets (not shown) formed on the front and rear faces of the roaster unit 22, and is angled toward the rear of the trailer so that grease and other liquids collected in the troughs 72*a*, 72*b* flow out of drain pipes 74 or 76 protruding from the rear face of the roaster unit 22. The bottom of the roaster unit 22 is V-shaped as shown, and an additional drain pipe 78 located at the bottom of the unit drains any liquids not caught by the troughs 72*a*, 72*b*. A water pipe 84 disposed above the grating 70 has a number of spaced spray nozzles 86 for dowsing the interior of the roaster unit 22 with water in the unlikely event of a grease fire in the roaster unit 22. The water pipe 84 terminates in a stub 88 on the rear of the roaster unit 22, and can be coupled to a garden hose or other locally available water supply. A temperature probe 90 supported in a junction box 91 mounted on the rear face of the roaster unit 22 measures the air temperature inside the roaster unit 22. The probe produces an electrical temperature signal, and the signal is supplied to control module 24 via line 92.

Referring to FIGS. 1 and 4, the control module 24 includes a user interface panel 94, a controller 96, and a pair of electric motor driven blower units 110 and 112. The blower units 110 and 112 are mounted below the interface panel 94, and are activated by controller 96 to control the cooking temperature in roaster unit 22, as explained below. The controller 96 may be mechanized with relay or solid state logic circuits or a programmed microprocessor, for example. The controller 96 receives inputs from temperature probe line 92 and a number of operator actuated switches 98 mounted on the interface panel 94, and generates outputs for the blower units 110 and 112, and a number of interface panel indicator lamps 100. For example, the switches 98 may include a master power switch, a rotisserie control switch, a charcoal draft control switch and a roaster exhaust control switch. The panel 94 also includes a temperature gauge 102 that displays the temperature measured by the temperature probe 90. For operator convenience roaster temperature gauges 104 and 106 are also provided on the front and rear faces of the roaster unit 22.

The blower unit 110 is selectively activated by the controller 96 to exhaust air from the roaster unit 22. The blower unit 110 includes an inlet 110*a* and an outlet 110*b*. The inlet 110*a* is manually connected (with a flexible hose, for example) to an exhaust pipe 114 passing through the rear face of roaster unit 22, so that activation of the blower unit 110 by controller 96 exhausts air from the interior of roaster unit 22 to the atmosphere via outlet 110*b*. The roaster exhaust control switch on control interface panel 94 is selectively positioned to OFF or ON, and in the ON setting enables automatic control of the blower unit 110 by controller 96. When the switch is in the ON position, the controller 96 activates the blower unit 110 to prevent the temperature in roaster unit 22 from exceeding a calibrated high temperature limit such as 400° F. In practice, the controller 96 turns on the blower unit 110 when the temperature measured by probe 90 exceeds the high temperature limit, and subsequently turns off the blower unit 110 when the measured temperature falls below a setpoint that is 5-10° F. below the high temperature limit. This control can be enabled whether the heat source is LP gas or charcoal.

The blower unit 112 is selectively activated by the controller 96 to supply supplemental combustion air to the heating unit 48 when the roaster unit 22 is being heated with charcoal. The blower unit 112 includes an inlet 112*a* and an outlet 112*b*. The outlet 112*a* is manually connected (with a flexible hose, for example) to the air pipe stub 66 of heating unit 48 so that activation of the blower unit 112 by controller 96 supplies supplemental combustion air to the charcoal to increase the heat produced by the charcoal. The charcoal draft control switch on control interface panel 94 is selectively positioned to OFF or ON, and in the ON setting enables automatic control of the blower unit 112 by controller 96. When the switch is in the ON position, the controller 96 activates the blower unit 112 to prevent the temperature in roaster unit 22 from falling below a low temperature limit such as 200° F. The controller 96 turns on the blower unit 112 when the temperature measured by probe 90 falls below the low temperature limit, and subsequently turns off the blower unit 112 when the measured temperature rises above a setpoint that is 5-10° F. above the low temperature limit.

Figure 7:
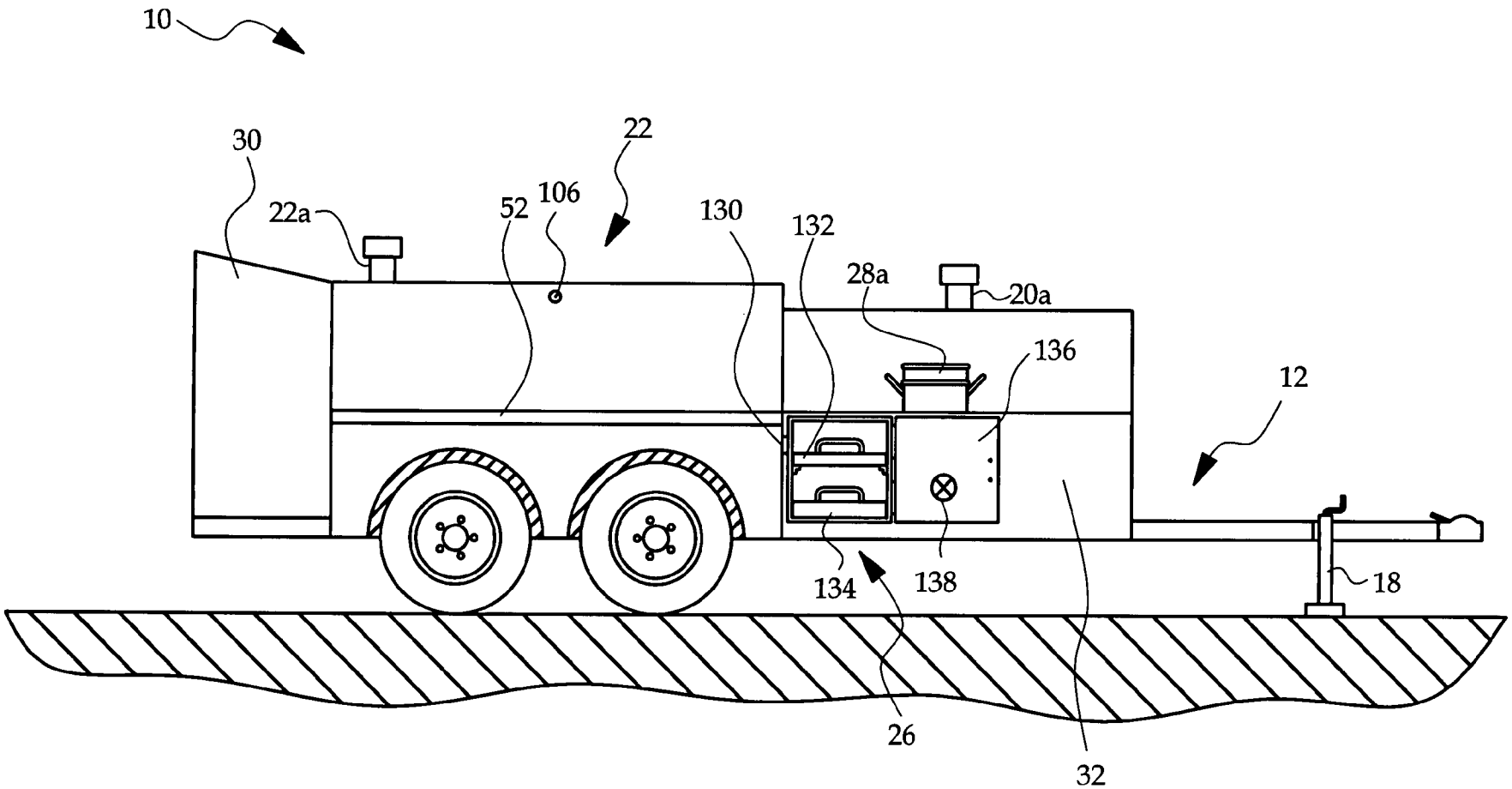
FIG. 7 is a side view of the mobile cooking apparatus of this invention, depicting the roaster unit, a smoker unit, and a deep frying unit.

Referring to FIG. 7, the smoker unit 26 is located adjacent the front panel of roaster unit 22, and is coupled to the roaster unit 22 by a smoke pipe 130. The smoker sidewalls support upper and lower slide-in trays 132, 134 and the access door 136 includes an adjustable draft damper mechanism 138. Charcoal or the like is loaded into the lower slide-in tray 134, and the upper tray 132 can be filled with water. If a smoke odor is desired, hickory chips or the like can be mixed in with the charcoal in the lower tray 134. Air entering the damper mechanism 138 in access door 136 is combusted with the charcoal in the smoker unit 26, and passes through the roaster unit 22 via smoke pipe 130. The water in tray 132 adds moisture to the air in roaster unit 22 so that meat cooking in roaster unit 22 retains its moisture.

The grill unit 20 may include a deep-fryer for cooking small food items such as french-fried potatoes and vegetables, and a grating for hamburgers, sausages, and the like. Cooking heat is supplied by a number of individually adjusted LP gas burner units (not shown) supplied by an LP gas tank stowed in the compartment 32 as mentioned above. The access door 20*b* is provided with an insulated handle 20*c*, and the door 20*b* is opens downward as shown in FIG. 2. A drain 120 at the base of the grill unit 20 drains grease and any other liquid passing through the grating.

In summary, the present invention provides a mobile cooking apparatus that is configurable and that addresses health safety concerns typically associated with on-site outdoor food preparation. While the present invention has been described with respect to the illustrated embodiment, it is recognized that numerous modifications and variations in addition to those mentioned herein will occur to those skilled in the art. Accordingly, it is intended that the invention not be limited to the disclosed embodiment, but that it have the full scope permitted by the language of the following claims.

The invention claimed is:

1. Configurable outdoor cooking apparatus comprising:

a roasting compartment having a first opening for cooking access and a second opening for heating source access;

a grating disposed in said roasting compartment adjacent said first opening for supporting food items to be cooked;

support means disposed in said roasting compartment adjacent said second opening;

a removable heating unit that is received through said second opening and supported by said support means for supplying heat for cooking said food items, said heating unit being heat source configurable;

a temperature probe extending into said roasting compartment to measure a temperature therein;

a controller for comparing said measured temperature to a high limit reference temperature; and exhaust means activated by said controller to exhaust air from said roaster compartment when the measured temperature exceeds said high limit reference temperature.

2. The configurable outdoor cooking apparatus of claim 1, further comprising:

a grease shield disposed between said grating and said removable heating unit for preventing food items and grease falling from said grating from dropping into said removable heating unit, said grease shield having peripheral troughs for collecting grease and other liquids and directing them to one or more drains of said roasting compartment.

3. The configurable outdoor cooking apparatus of claim 1, wherein said support means comprises a pair of rails, and said removable heating unit includes peripheral flanges that slide on said rails.

4. The configurable outdoor cooking apparatus of claim 1, wherein said exhaust means comprises:

an exhaust pipe passing through a wall of said roasting compartment; and an electric-motor driven blower having an inlet and an outlet, said inlet begin coupled to said exhaust pipe and said outlet being coupled to atmospheric air.

5. The configurable outdoor cooking apparatus of claim 1, wherein said controller deactivates said exhaust means when said measured temperature falls below a setpoint that is lower than said high limit reference temperature.

6. The configurable outdoor cooking apparatus of claim 1, further comprising a user interface switch coupled to said controller for selectively enabling and disabling activation of said exhaust means by said controller.

7. The configurable outdoor cooking apparatus of claim 1, wherein said heating unit has charcoal for its heat source, where:

said controller compares said measured temperature to a low limit reference temperature; and draft means activated by said controller supplies supplemental combustion air to the charcoal in said heating unit when said measured temperature falls below said low limit reference temperature.

8. The configurable outdoor cooking apparatus of claim 7, wherein said draft means comprises:

an air pipe passing through a wall of said heating unit; and an electric-motor driven blower having an inlet and an outlet, said inlet begin coupled to atmospheric air and said outlet being coupled to said air pipe.

9. The configurable outdoor cooking apparatus of claim 7, wherein said controller deactivates said draft means when said measured temperature rises above a setpoint that is higher than said low limit reference temperature.

10. The configurable outdoor cooking apparatus of claim 7, further comprising a user interface switch coupled to said controller for selectively enabling and disabling activation of said draft means by said controller.

11. The configurable outdoor cooking apparatus of claim 1, wherein said heat source is charcoal or LP gas.

12. The configurable outdoor cooking apparatus of claim 1, further comprising:

a smoker compartment coupled to said roaster compartment for selectively introducing smoke into said roaster compartment.

13. The configurable outdoor cooking apparatus of claim 1, further comprising:

a water sprinkler pipe disposed in said roaster compartment, and passing through a wall of said roaster compartment for attachment to a source of water for dowsing fires in said roaster compartment.

14. The configurable outdoor cooking apparatus of claim 1, wherein said roaster compartment includes a V-shaped floor, and a drain pipe disposed therein.

* * * * *